US005587649A

United States Patent [19]

Garrett

[11] Patent Number: 5,587,649

[45] Date of Patent: Dec. 24, 1996

[54] THERMAL PERFORMANCE MATCHED CURRENT LIMITING CIRCUIT, AND BATTERY USING SAME

[75] Inventor: Scott M. Garrett, Lawrenceville, Ga.

[73] Assignee: Motorola, Inc., Schaumburg, Ill.

[21] Appl. No.: 316,678

[22] Filed: Sep. 30, 1994

[51] Int. Cl.[6] ..... G05F 1/573

[52] U.S. Cl. ..... 323/369; 323/224; 323/277; 323/303; 320/35; 320/39

[58] Field of Search ..... 323/274, 277, 323/298, 303, 366, 224, 369; 320/35, 39

[56] References Cited

U.S. PATENT DOCUMENTS 3,211,989 10/1965 Mintz et al. ..... 323/279

3,426,265 2/1969 Till ..... 323/278

3,723,774 3/1973 Rogers ..... 361/101

5,337,228 8/1994 Yang ..... 363/86

*Primary Examiner*—Peter S. Wong

*Assistant Examiner*—Shawn Riley

*Attorney, Agent, or Firm*—Kenneth M. Massaroni; Scott M. Garrett

[57] ABSTRACT

A battery pack (10) includes a circuit (14) for assuring that a device (16) connected to the battery pack performs in a manner consistent with design requirements, while not exceeding certain thresholds for safety in volatile environments. The battery pack (10) includes a circuit (14) which matches performance requirements with the overall temperature likely to be generated by the device (16).

9 Claims, 5 Drawing Sheets

THERMAL PERFORMANCE MATCHED CURRENT LIMITING CIRCUIT, AND BATTERY USING SAME

TECHNICAL FIELD

This invention relates in general to battery packs for powering electronic devices, and more specifically, to battery packs for use in environments containing volatile fumes or vapors.

BACKGROUND

Portable, or wireless, electronic communication devices have proven to be very useful to society. The widespread use of mobile and portable two-way radios is a good example. Applications for such radios include police, fire, and civil servants, trucking fleets, and industrial intracompany communications. Typically, at least one of the communicating parties is moving or at a location where wired stationary communications is not readily available.

Often such electronic communications devices are used in locations where the atmosphere contains volatile fumes, creating the risk of explosion. Examples of volatile atmospheres include utilities personnel responding to a natural gas pipe rupture, or when a chemical reactor is venting hydrogen gas. Under such conditions the potential exists for the electronics in the area to cause ignition.

To eliminate the risk of ignition, several agencies, such as Factory Mutual in the U.S. and CENELEC in Europe, have established design guidelines allowing designers to make electronic and electrical apparatuses intrinsically safe. That is, the devices and apparatuses have safeguards built in to eliminate the risk of ignition, even under fault conditions. The safety of such devices cannot be compromised by naturally occurring incidents such as dust intrusion or component failure. Accordingly, the device must be designed with expectations of failure in a potentially hazardous atmosphere.

Three parameters that must be considered when designing an intrinsically safe portable electronic device: voltage, current, and power sourced to the device. Voltage is limited to a level based on the maximum capacitance that could be charged, since such a charged capacitance could rapidly discharge were a conductor applied across it's electrodes. The energy of the resulting spark must not be able to cause ignition. The output current to the device is limited to avoid charging the magnetic fields of inductors where an inductance so charged could rapidly break contact and arc; again, the resulting spark must not be energetic enough to cause ignition. Power to the device must be limited so that the surface of any given component cannot heat to an unsafe temperature. Typically this is done by defining the power available as the product of the limited voltage value and the limited current value. The smallest component in the device that could receive this power is then assumed to fail at a resistance that would consume that power, and the maximum surface temperature is then found from that component. It may be possible to reduce the surface temperature exposed to ambient conditions by encapsulating the component, thereby dissipating the heat energy of the component over a larger area.

Temperature classification of the device is dependent on what maximum surface temperature is achievable by any component of the device. The temperature classification of the device is determined at a specific ambient temperature, typically 40° C. If the same device were tested in the same manner at a cooler ambient, the resulting maximum surface temperatures would be likewise be lower. As a result, more power can be sourced to the device at cooler temperature, but power to the device must be more restrictive at temperature above the test ambient of 40° C. The result is that, over temperature, the maximum total power that can be sourced to the device is a linear, negatively sloped function of ambient temperature.

Since a portable electronic device is powered by a battery, the device is not energized until a battery is connected to it. Accordingly, the means by which the voltage and current levels are regulated to a safe level must reside between the device and the battery. If the battery is meant to be detachable while in the presence of a potentially hazardous atmosphere, then such means must reside in the battery itself, and all capacitance, inductance, and surface heat of such means is taken into consideration with the device when determining the safety level. A detachable battery is preferred since the alternative is a battery that can only be removed when in a known safe area. It would be considered an inconvenience to have to travel to a safe area to change batteries. In addition, the semi-permanent type of battery without a safety means could not be carried along with the device since its unregulated output could cause ignition of any volatile gasses encountered.

The amount of capacitance found in many communications devices forces the battery safety means to limit the voltage to a level that may degrade the performance of the device. Given such a limit, it may be impossible to make a given device safe, since device performance is compromised. One possible solution to this problem is to reduce the device capacitance to an acceptable level, and limit the battery voltage to a level slightly in excess of the device's operating voltage threshold. This forces the designer to choose a current limit based either on the device inductance, or based on the thermal characteristics of components in the device that are exposed to the ambient atmosphere. However, since the trend in this field is to make the device small, the components inside are likewise small and can reach very high temperatures when they fail. Accordingly, the battery current limit is usually based on power. This current limit is likely to challenge the designer since it may not allow the device to operate at otherwise maximum settings.

The restrictions of space, cost, and current drain, coupled with the redundancy requirement, dictate that the current limiter is best implemented with discrete components in the form of a simple linear regulator with a single pass device. However, the simplicity of such designs makes them susceptible to temperature effects. Specifically, given an increase in temperature, the bias voltage of a transistor is less than at a cooler temperature. In a simple discrete limiter this has the effect of causing the resulting current limit to be less than what the device demands at higher a temperature. The deviation is attributed to a typical temperature coefficient effect of about −2 mV/°C. of transistor bias voltage.

Referring now to FIG. 1 there is illustrated therein curves of current vs. temperature for the safe power level line 2, maximum current demand of the device line 4, and the limit of a simple discrete limiter line 6. The response of the limiter changes more than the device's demand since the device typically has internal voltage regulators which partially compensate for the change in bias voltage over temperature. As can be seen, at lower temperatures the limiter could allow a level of current such that an unsafe temperature could be reached. By lowering the cool temperature current limit, however, the high temperature performance is degraded since the response of the limiter is less than the demand of the device, as shown in FIG. 2. Consequently designers choose to sacrifice high temperature performance for the sake of safety.

Therefore, there exists a need for a current limiting means that matches the demand of the device while still limiting to a safe current level. The current limiter must more closely follow the maximum current demand change tendency over temperature, thereby providing a safe level of current over the entire temperature range.

DETAILED DESCRIPTION OF THE PREFERRED EMBODIMENT

Figure 1:
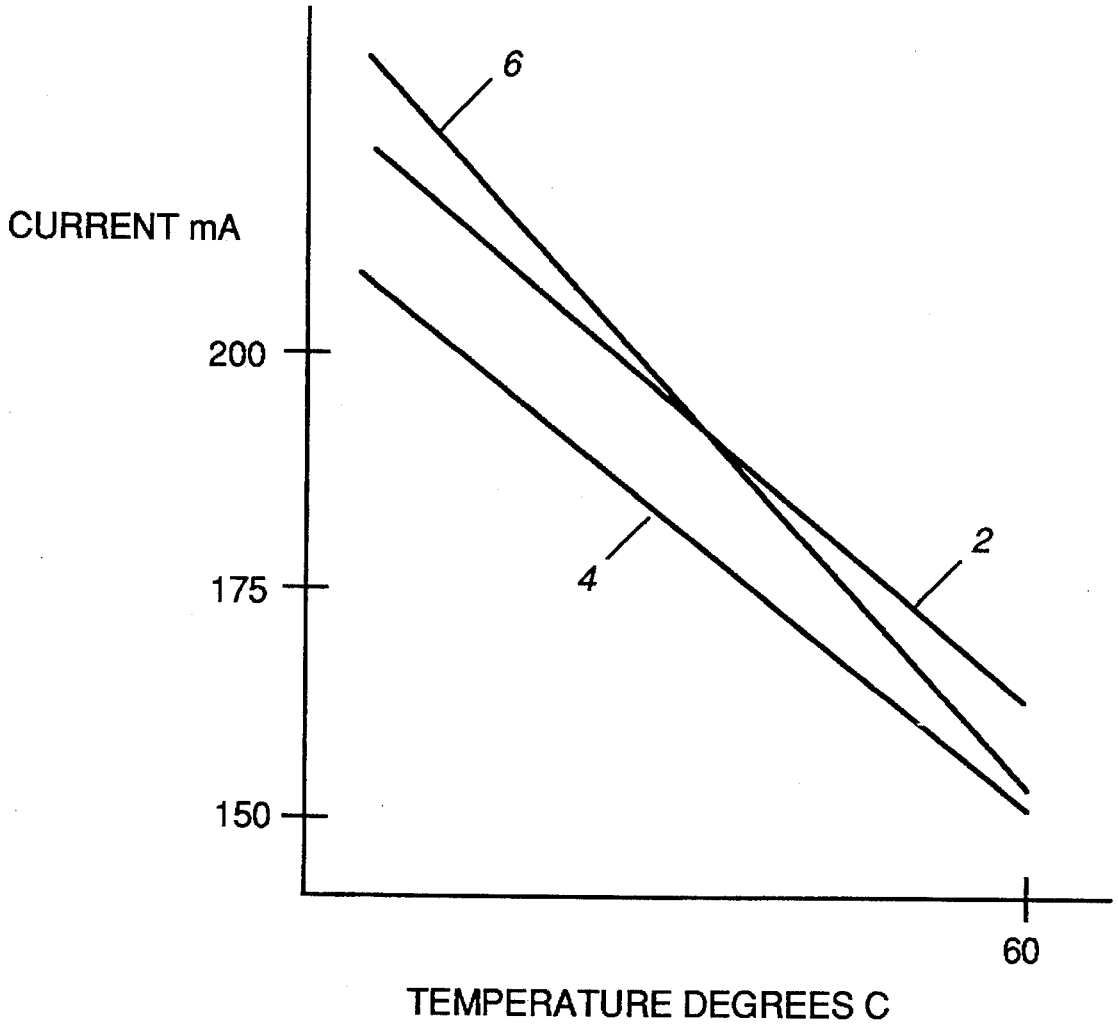
FIG. 1 is a graphic representation of current versus temperature for maximum safe current limit, response of a simple discrete limiter, and maximum current demand of a prior art device.
Figure 2:
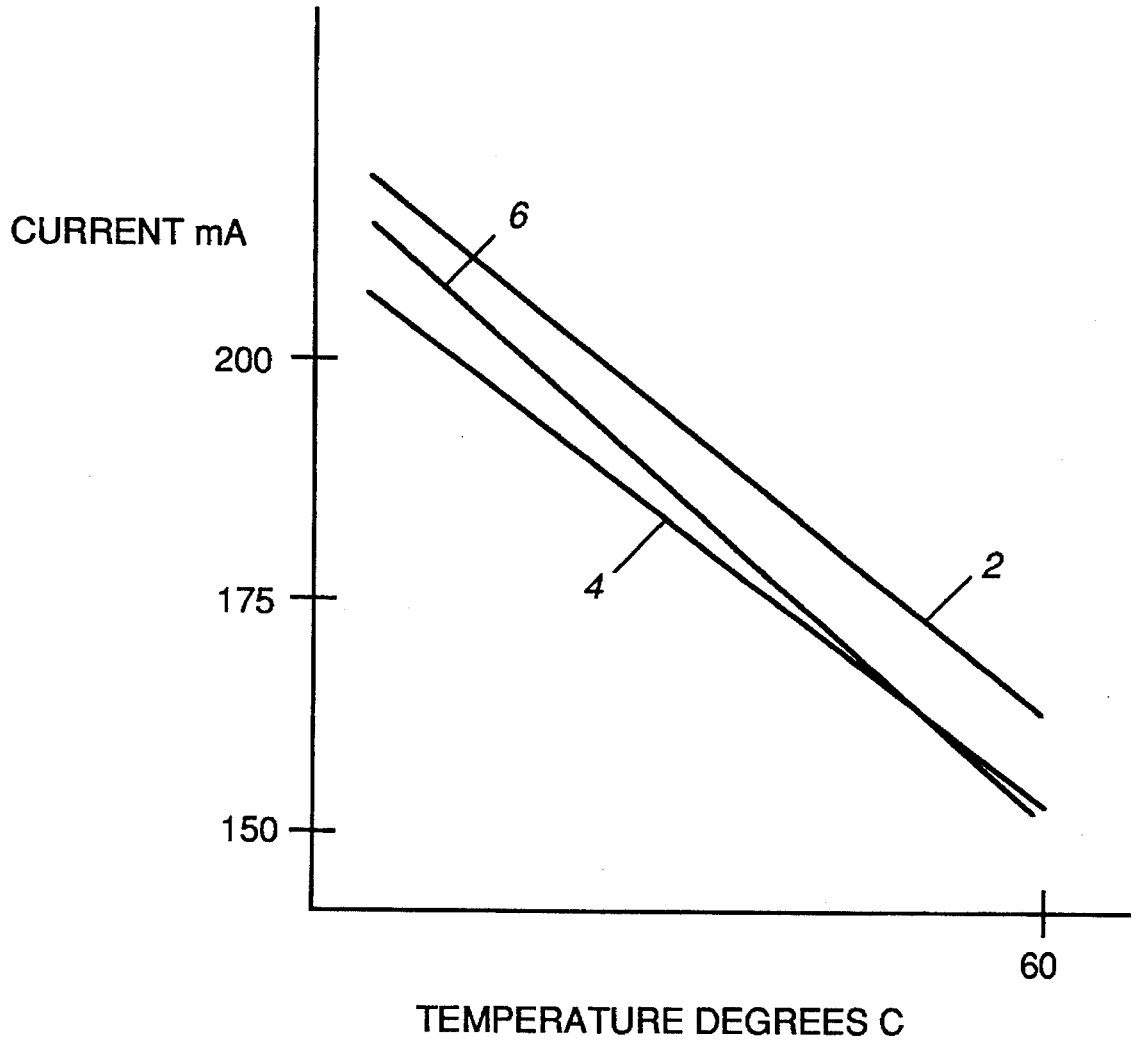
FIG. 2 is a second graphic representation of current versus temperature for maximum safe current limit, response of a simple discrete limiter, and maximum current demand of a prior art device.

While the specification concludes with claims defining the features of the invention that are regarded as novel, it is believed that the invention will be better understood from a consideration of the following description in conjunction with the drawing figures, in which like reference numerals are carried forward.

Figure 3:
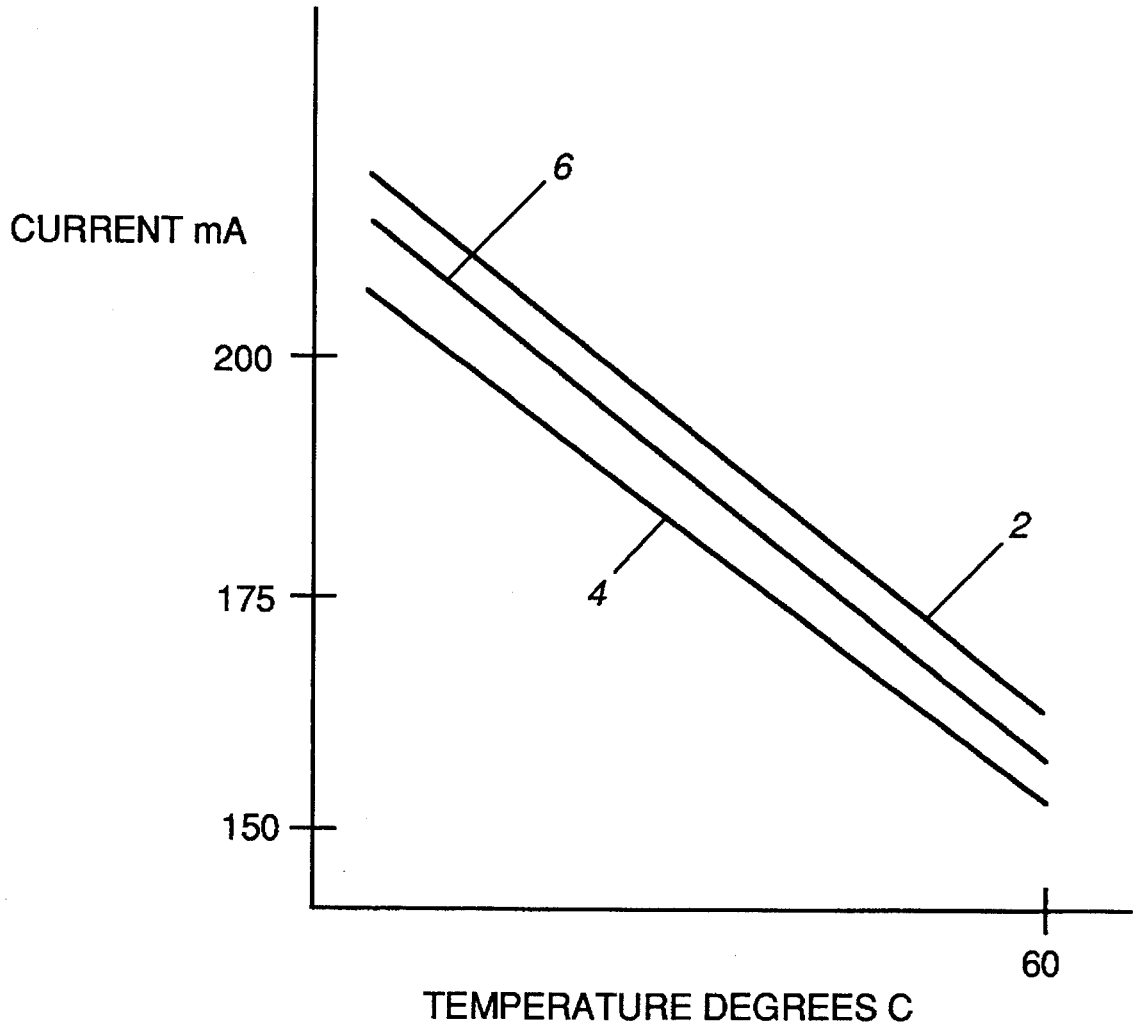
FIG. 3 is a graphic representation of current versus temperature for maximum safe current limit, response of a simple discrete limiter, and maximum current demand of a device, according to the instant invention.

Referring now to FIG. 3 is illustrated therein a graphic representation of current versus temperature for maximum safe current limit 2, response of a simple discrete limiter 4, and maximum current demand of a device 6, according to the instant invention. As may be appreciated from a perusal of FIG. 3, the current limiter more closely follows the maximum current demand change tendency over temperature, thereby providing a safe level of current over the entire temperature range. The result is a device which performs properly, and uniformly over a wide temperature range.

Figure 4:
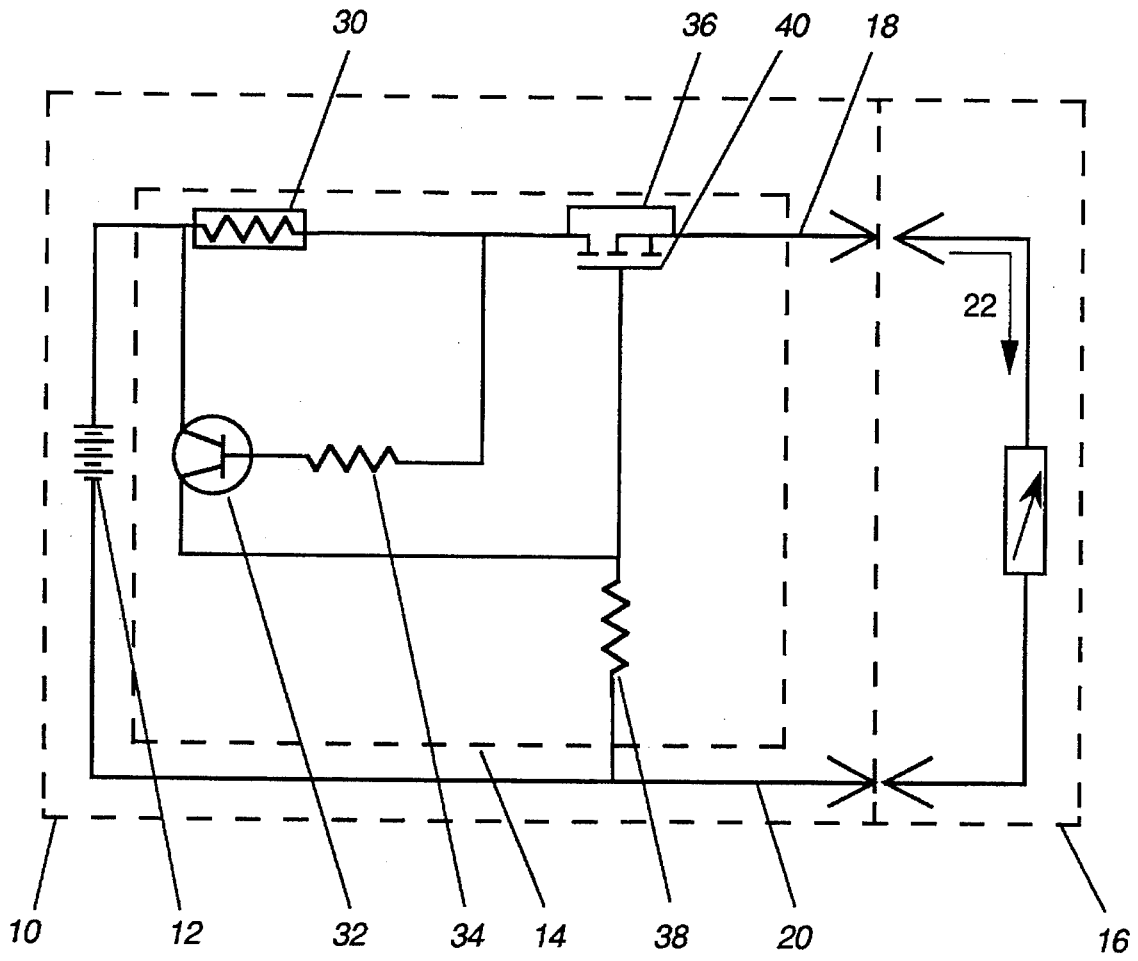
FIG. 4 is a circuit diagram of battery pack in accordance with the invention.

Referring now to FIG. 4, a circuit diagram of a battery pack 10 in accordance with the instant invention. The battery pack 10 contains a cell pack 12, a current limiting circuit 14, and a means for connecting, such as contacts 18 20 the battery pack to a device to be powered 16. The battery pack 10 provides a current that flows in the direction of the arrow 22. The battery pack 10 is typically enclosed in a housing, such as a plastic housing, having contacts 18 20 mounted so as to electrically connect with the device 16.

The current limiting circuit 14 is comprised of a sense resistance 30, a bipolar transistor 32, protection resistance 34, pass transistor 36, and bias resistor 38. Current sourced to the device 16 passes through the sense resistance 30 and produces a voltage, which is evident across the emitter-base junction of the bipolar transistor 32 and protection resistance 34. However, the protection resistance is chosen to be small such that substantially all of the voltage across the sense resistance is applied to the bipolar transistor 32. Protection resistance 34 provides redundancy and is not necessary for the circuit to function correctly.

Pass transistor 36, such as a P-channel enhancement mode MOSFET or a PNP bipolar transistor is also electrically located in series between the device 16 and the cells 12, Terminal 40 of the pass transistor 36 controls bias, and is connected to bias resistor 38. The pass transistor 36 is full enabled, that is, at its lowest impedance state, by connecting the other end of the bias resistor to a voltage sufficient to cause such a condition.

As current demand of the device 16 increases, a higher voltage is produced across the sense resistance 30. When the voltage across the sense resistance reaches the bias threshold, the bipolar transistor 32 begins to conduct current to the bias resistor 38. Bias to the pass transistor 36 is then reduced and the pass transistor increases in impedance. As the current limit level is reached, an equilibrium is reached between the bias of the bipolar transistor and the pass transistor. The bias on the bipolar transistor 32 causes it to conduct enough current to remove bias from the pass transistor 36 such that a current level limit is maintained.

If the sense resistance 30 were a fixed value, the output current level limit would change over temperature according to the temperature coefficient of the bipolar transistor's bias voltage. As mentioned above, this coefficient is negative in magnitude such that as temperature decreases, the bias voltage threshold increases. In order to reduce this effect, and thereby match the current level limit with the maximum current demand change tendency of the device, the sense resistance is made to vary over temperature.

Figure 5:
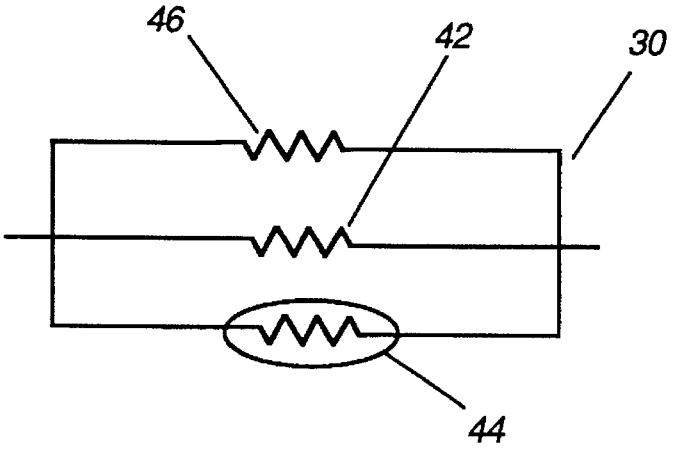
FIG. 5 is a circuit diagram of a first embodiment of a sense resistance in accordance with the invention.
Figure 6:
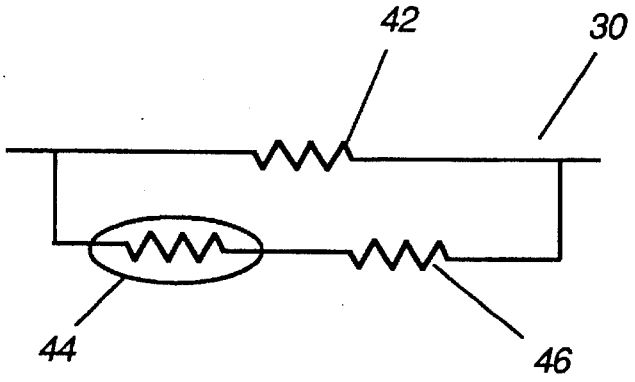
FIG. 6 is a circuit diagram of a second embodiment of a sense resistance in accordance with the invention.
Figure 7:
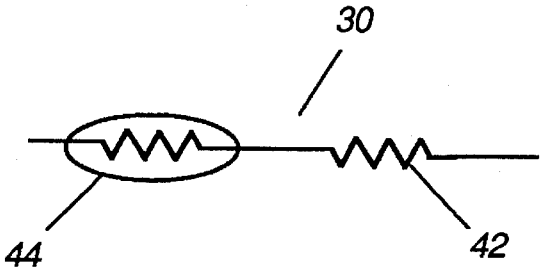
FIG. 7 is a circuit diagram of a third embodiment of a sense resistance in accordance with the invention.

Referring now to FIGS. 5–7, there is illustrated therein three alternative embodiments for sense resistance 30 of FIG. 4. In each is a base resistor 42. The value of the base resistor 42 is dictated by the desired current limit value at some convenient temperature, such as 25° C. The threshold bias voltage of the bipolar transistor at that temperature is divided by what current limit value is necessary at the same temperature. The result is the magnitude of the effective sense resistance in ohms. In FIGS. 5 and 6, the base resistance magnitude is slightly higher than this result; in FIG. 7 it is slightly lower. In FIG. 5, a thermistor 44 having a negative temperature coefficient is placed in parallel with the base resistor 42. The thermistor 44 has a resistance that is significantly larger in magnitude than the base resistor and is linearized by a fixed value resistor 46, also in parallel with the base resistor. The resistance magnitude of resistor 46 is likewise significantly greater than the base resistor 42.

FIG. 6 shows a configuration wherein the fixed value resistor 46 and thermistor 44 are connected in series together in parallel with the base resistor 42. The resistance magnitude of the fixed value resistor 46 in addition to the thermistor is significantly larger than the base resistor. In FIG. 7, the thermistor 44 is shown in series with the base resistor 42. No fixed value resistor is provided for linearization purposes, since the thermistor's resistance is much smaller than the base resistor, and the effective resistance of the resulting sense resistance can not have a value lower that the base resistor.

The process by which the exact values are chosen is iterative, and depends on the amount of matching necessary, relative difference between the maximum safe current and the maximum current required by the device, and the standard values available. However, a good rule of thumb is that the resistance of the thermistor at 25° C. should be about 100 times larger than the base resistor, and the resistance of the fixed value resistor should be about one third that of the thermistor at 25° C.

The current limiting circuit may be implemented in either a high side or low side configuration. By high side it is meant that the sense resistance and pass transistor are electrically connected in series between the most positive electrical potential of the cells and the output connection means; a low side configuration places the sense resistance and pass transistor in series between the most negative electrical potential of the cells. FIG. 4 shows the circuit in a high side configuration. In a low side configuration, the pass transistor could be a N-channel enhancement mode MOSFET, and the bipolar transistor would be an NPN type. The operation of the two configurations is the same; current sourced to the device passes through the sense resistance and achieves enough voltage to bias the NPN transistor to conduct and it removes current from the bias terminal of the pass transistor.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A battery pack for powering an electronic device having a maximum current demand, in a volatile atmosphere, said battery pack comprising:

at least one battery cell;

current limiting means establishing a current level limit responsive to temperature such that a change of said current level limit over a temperature range matches the maximum current demand of said device over said temperature range, said current limiting means comprising:

a sense resistance means responsive to temperature and characterized by an effective resistance magnitude which has a negative temperature coefficient, said sense resistance means being electrically connected in series between said at least one cell and at least one of said electrical contacts;

a pass transistor having at least three terminals, the first and second of which are electrically connected in series between said sense resistance means and one of said electrical contacts;

a bias resistor for supplying bias to said pass transistor, said bias resistor being electrically connected between said third terminal of said pass transistor means and a voltage potential; and a bipolar transistor, having a base, emitter, and collector, forming a base-emitter junction, electrically connected such that said collector is electrically connected to said third terminal of said pass transistor means; and a pair of electrical contacts for electrically coupling said battery pack to said device.

2. A battery pack as in claim 1, wherein said sense resistance means comprises:

a base resistor; and a resistive network with a negative temperature coefficient connected in parallel with said base resistor.

3. A battery pack as in claim 1, wherein said sense resistance means further comprises:

a thermistor connected in series with a base resistor.

4. A battery pack as in claim 2, wherein said resistive network comprises:

A fixed value resistor electrically connected in series with a thermistor.

5. A battery pack as in claim 2, wherein said resistive network comprises:

a fixed value resistor and a thermistor, each electrically connected in parallel with said base resistor.

6. A battery pack as in claim 1, wherein said sense resistance means and said pass transistor means are electrically connected in a high side configuration.

7. A battery pack as in claim 6, wherein said bipolar transistor is a PNP type transistor, and said pass transistor is a P-channel enhancement mode MOSFET with source, gate, and drain connections; said source being said first terminal and electrically connected to said sense resistance means, and said drain being said second terminal and electrically connected to one electrical contact, and said gate being said third terminal and electrically connected to said bias resistor and said collector of said bipolar transistor.

8. A battery pack as in claim 1, wherein said sense resistance means and said pass transistor means are electrically connected in a low side configuration.

9. A battery pack as in claim 8, wherein said pass transistor means is a N-channel enhancement mode MOSFET with source, gate, and drain connections; said source being said first terminal and electrically connected to said sense resistance means, and said drain being said second terminal and electrically connected to said means for connecting to said device, and said gate being said third terminal and electrically connected to said bias resistor and said collector of said bipolar transistor, and said bipolar transistor is a NPN type.

* * * * *